US011497959B1

(12) United States Patent
Meregillano

(10) Patent No.: US 11,497,959 B1
(45) Date of Patent: Nov. 15, 2022

(54) COMPRESSION TRAINING SYSTEM

(71) Applicant: Larry Eugene Meregillano, Chino, CA (US)

(72) Inventor: Larry Eugene Meregillano, Chino, CA (US)

( * ) Notice: Subject to any disclaimer, the term of this patent is extended or adjusted under 35 U.S.C. 154(b) by 0 days.

(21) Appl. No.: 17/729,928

(22) Filed: Apr. 26, 2022

Related U.S. Application Data

(60) Provisional application No. 63/179,973, filed on Apr. 26, 2021.

(51) Int. Cl.
*A63B 23/03* (2006.01)
*A63B 23/18* (2006.01)

(52) U.S. Cl.
CPC ..... *A63B 23/032* (2013.01); *A63B 23/18* (2013.01); *A63B 2220/56* (2013.01)

(58) Field of Classification Search
CPC ..... A63B 23/032; A63B 23/025; A63B 23/03; A63B 23/18; A63B 23/185; A63B 2220/56; A63B 21/4003; A63B 21/4023; A63B 21/4039
See application file for complete search history.

(56) References Cited

U.S. PATENT DOCUMENTS 3,805,771 A * 4/1974 Wright ..... A61C 7/00 482/11
4,221,381 A * 9/1980 Ericson ..... A63B 23/18 73/239
5,165,393 A * 11/1992 Kawaguchi ..... A63H 27/10 482/13
5,183,057 A * 2/1993 Syrop ..... A61C 19/04 128/845
6,471,621 B2 * 10/2002 Horstel ..... A63B 23/18 482/11
9,561,399 B2 * 2/2017 Acosta ..... A63B 21/0085
9,770,566 B2 * 9/2017 Meyers ..... A61B 5/091
2009/0156952 A1 * 6/2009 Hunter ..... A61M 16/209 600/538

* cited by examiner

*Primary Examiner* — Megan Anderson

(57) ABSTRACT

A compression training system comprises an aperture tool, a tube, and a manometer. The tube comprises a first end opening and a second end opening. The aperture tool is releasably attached to the manometer via the tube. The aperture tool comprises a through aperture in communication with the first end opening of the tube. The aperture tool is shaped and sized to be placed between lips of a user. The manometer comprising a pressure inlet. The second end opening of the tube is hermetically attached around the pressure inlet such that the through aperture is in fluid communication with the manometer.

9 Claims, 10 Drawing Sheets

COMPRESSION TRAINING SYSTEM

FIELD OF THE INVENTION

The present invention relates generally to compression training tools. More specifically, the present invention provides compression training tools that allow a user to employ variable back pressure to exercise the muscles of the face.

BACKGROUND OF THE INVENTION

Mouthpiece of a brass instrument is configured to be placed on an instrument player's lip. Properly practicing and training the control of the lip muscles and the surrounding muscles are important in developing lip muscle strength and endurance. However, it has always been difficult to train the muscles within the facial area surrounding the lips due to a lack of information and available equipment to do so.

The present invention presents a solution to the issue mentioned above by providing compression training tools.

SUMMARY OF THE INVENTION

The present invention provides a compression training system. The system comprises an aperture tool, a tube, and a manometer. The tube comprises a first end opening and a second end opening. The aperture tool is releasably attached to the manometer via the tube. The aperture tool comprises a through aperture in communication with the first end opening of the tube. The aperture tool is shaped and sized to be placed between lips of a user. The manometer comprising a pressure inlet. The second end opening of the tube is hermetically attached around the pressure inlet such that the through aperture is in fluid communication with the manometer.

The present invention allows the instrument player to train and assist growth for muscles of the face that are involved in tone production. Further, the present invention allows the instrument player to train muscles that are involved in compressing and controlling the velocity of air as it passes through a vibrating aperture. Utilizing the present invention, the instrument player can increase the muscular strength of the lip and the surrounding muscles.

DETAIL DESCRIPTIONS OF THE INVENTION

Figure 1:
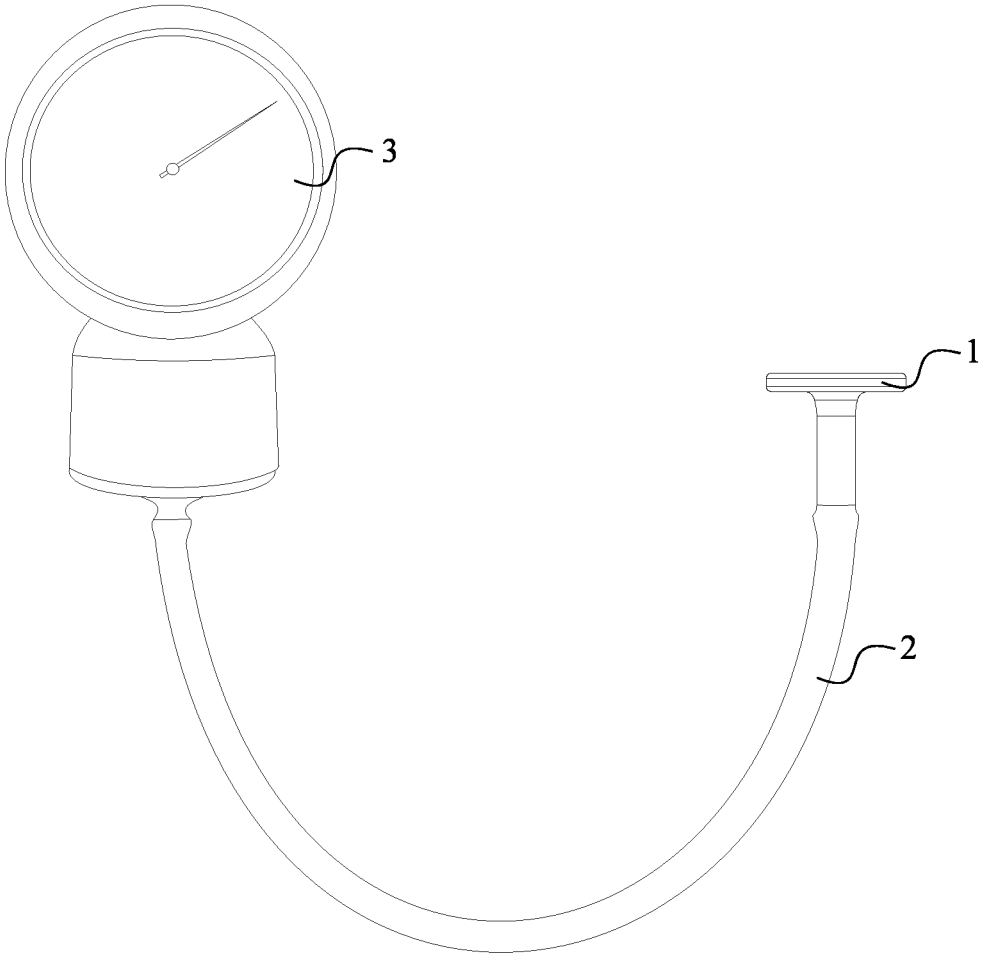
FIG. 1 is a front view of the compression training system of the present invention.

All illustrations of the drawings are for the purpose of describing selected versions of the present invention and are not intended to limit the scope of the present invention.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim limitation found herein and/or issuing here from that does not explicitly appear in the claim itself.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the claims found herein and/or issuing here from. The present disclosure contains headers. It should be understood that these headers are used as references and are not to be construed as limiting upon the subjected matter disclosed under the header.

Figure 2:
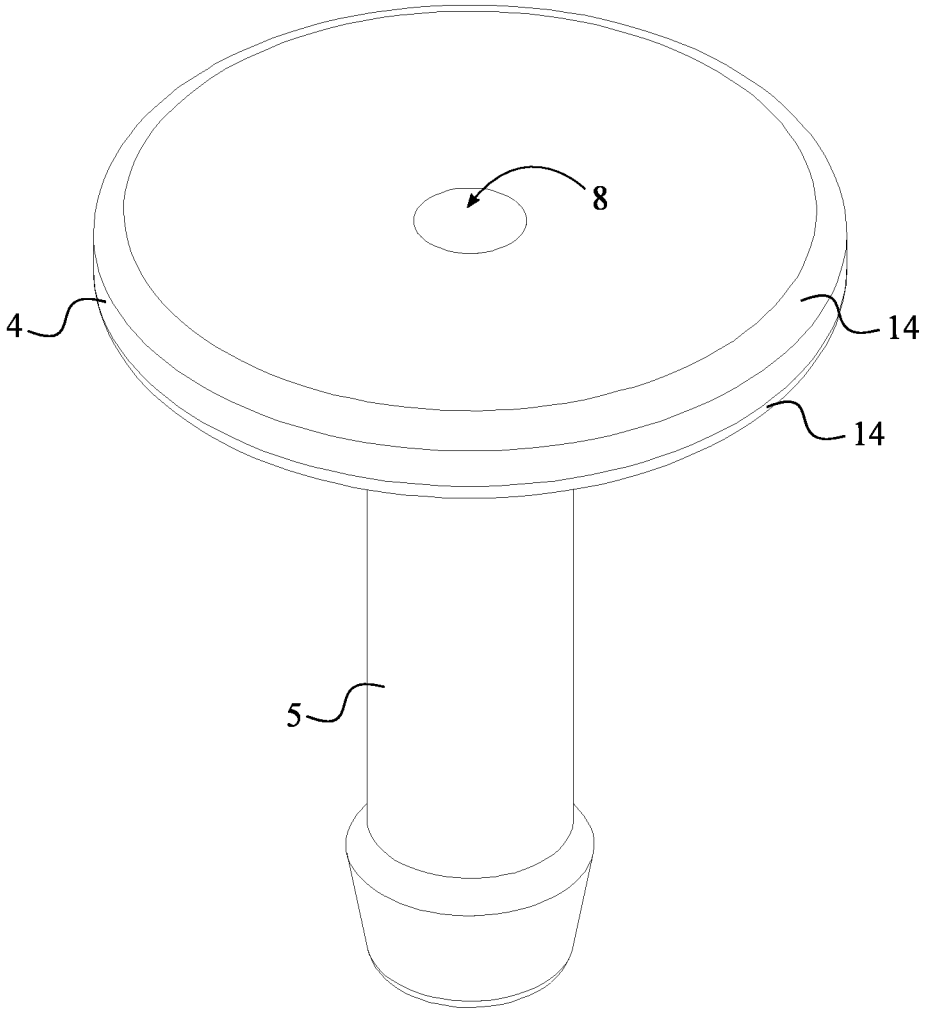
FIG. 2 is a top front perspective view of the aperture tool.
Figure 3:
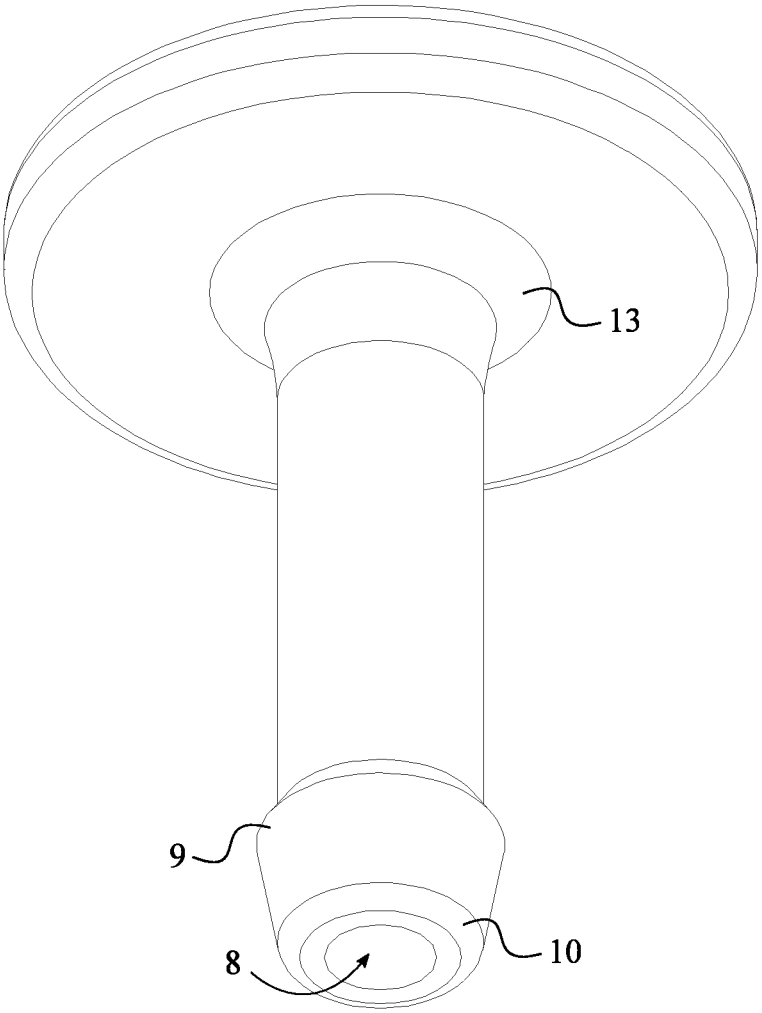
FIG. 3 is a bottom rear perspective view of the aperture tool.
Figure 4:
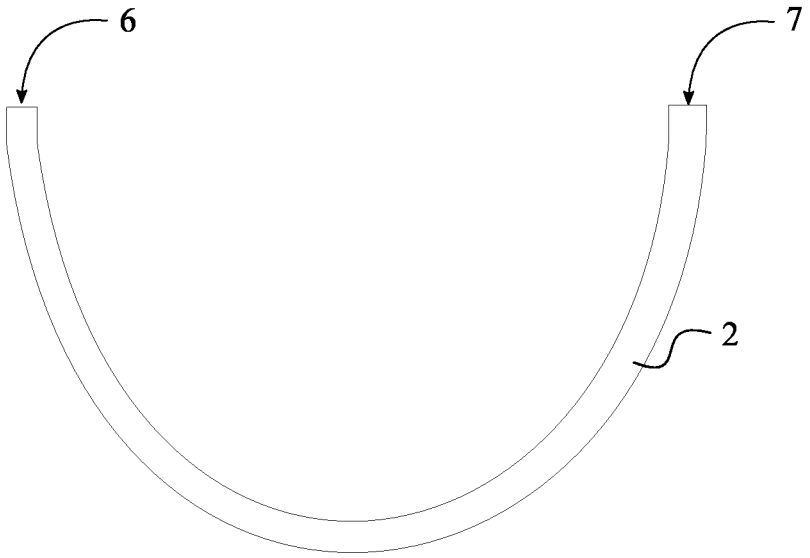
FIG. 4 is a front view of the tube.
Figure 6:
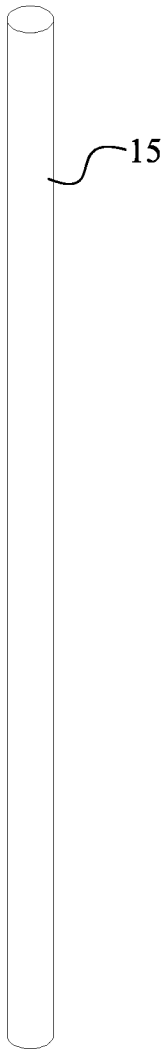
FIG. 6 is a top front perspective view of the pencil member.
Figure 7:
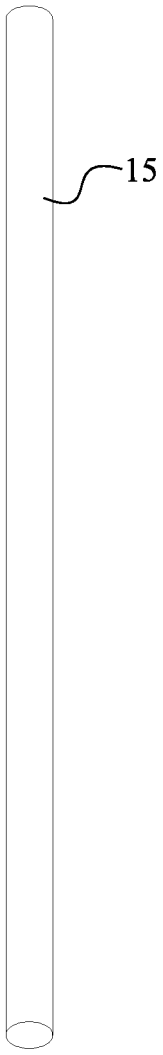
FIG. 7 is a bottom rear perspective view of the pencil member.
Figure 8:
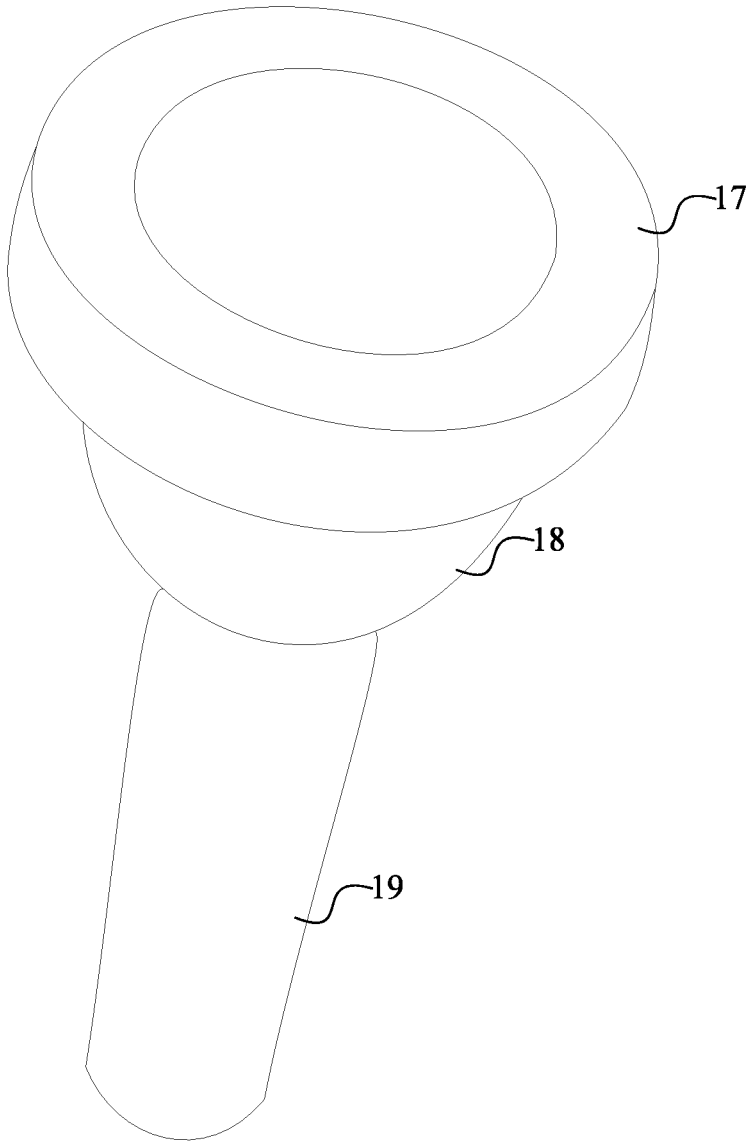
FIG. 8 is a top front perspective view of the brass mouthpiece.
Figure 9:
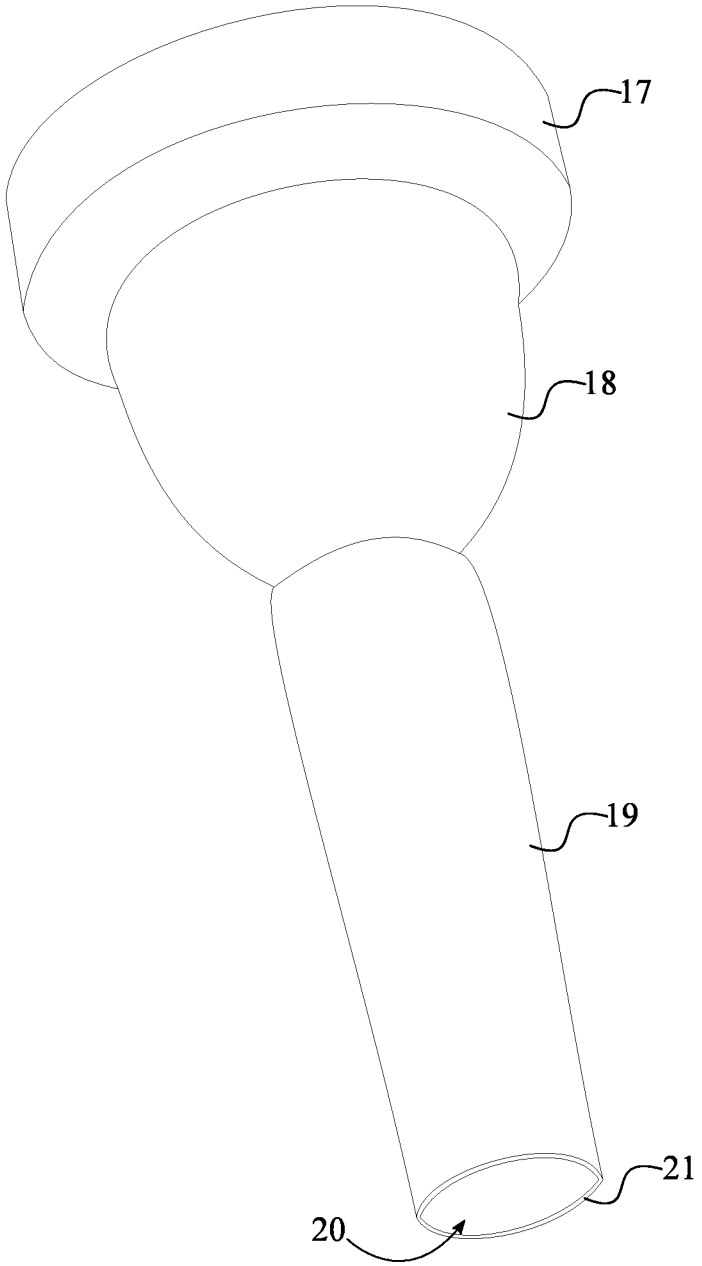
FIG. 9 is a bottom rear perspective view of the brass mouthpiece.
Figure 10:
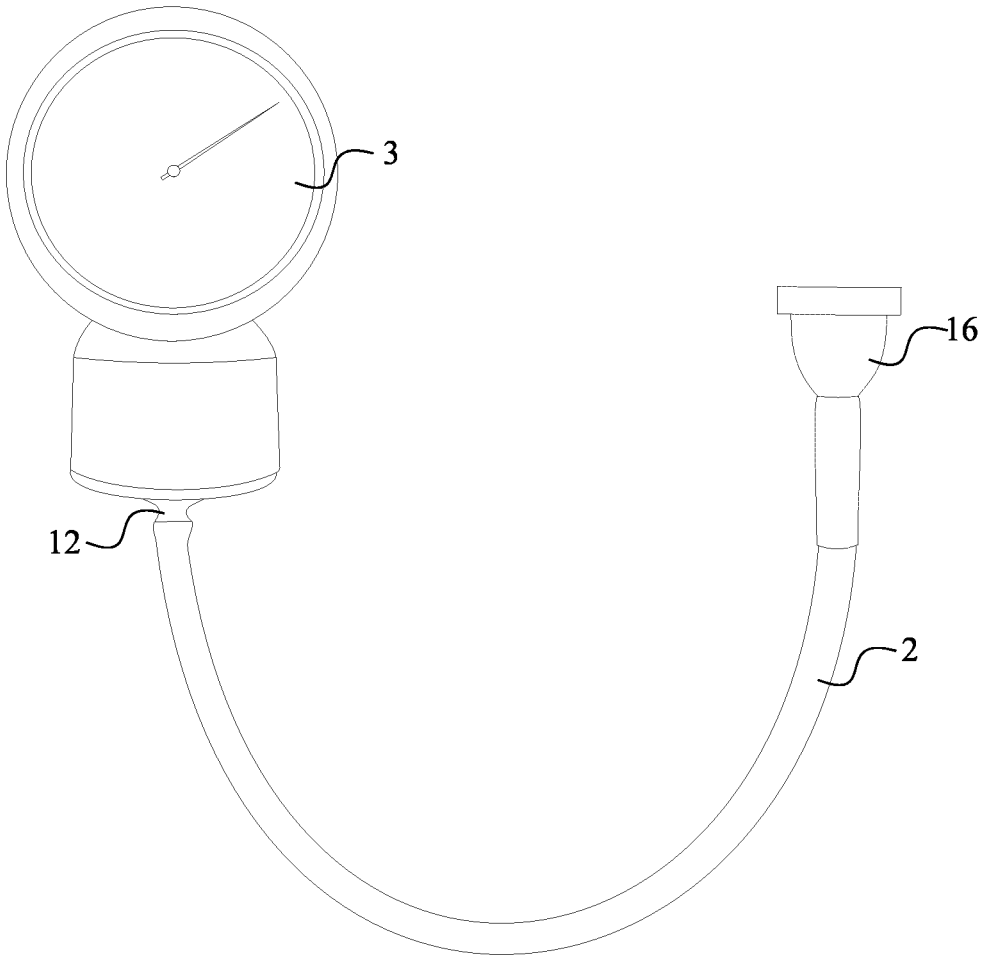
FIG. 10 is a front view of another embodiment of the compression training system of the present invention.

In reference to FIGS. 1-10, the compression training system of the present invention comprises an aperture tool 1, a tube 2, and a manometer 3. The aperture tool may be a specially designed component as shown in FIGS. 1-3. However, the aperture tool can also be a brass mouthpiece 16 as shown in FIGS. 8-10. Moreover, the present invention may further comprise a pencil member 15. The aperture tool 1, the brass mouthpiece 16, and the pencil member 15 can be packaged together and sold as a kit, or they can be separately packaged and sold.

The compression training system of the present invention is used to develop and train muscles of the lips and the surrounding area of a user that are involved in compressing and controlling the velocity of air through an instrument with an aperture tool or of the like. The present invention is a closed system that the user should trap compressed air from the user's oral cavity and squeeze the air forward. The user's tongue should drive the air like the motion of spurting or spitting water from the user's mouth without blowing from lungs. The present invention allows the user to employ variable back pressure to exercise the muscles of the face. The present invention provides effective exercises that allow the muscles that are moving through their natural range of motion. In addition, the present invention also works the muscle fibers that conform to the compression training tools. Utilizing the present invention, the user is generating compression with the muscles of the face while maintaining the hermetic seal on the compression training tools against the lips. The muscle fibers are conforming to the shape of the compression training tools while the entire facial musculature is working against the variable back pressure provided by the present invention.

In reference to FIG. 1-5, in a preferred embodiment the aperture tool 1 is configured to comfortably fit in and align against the user's lip. The aperture tool 1 may be releasably attached to the manometer 3 via the tube 2, which comprises a first end opening 6 and a second end opening 7. The aperture tool 1 comprises a through aperture 8 in communication with the first end opening 6 of the tube 2. The aperture tool 1 is shaped and sized to be placed between lips of the user. In a preferred embodiment, the aperture tool 1 comprises a disc 4 and a shank 5. The disc 4 is configured to be placed in between the user's lips and teeth. The shank 5 allows a tight seal connection with the tube 2. The tube 2 is an elongated hollow tube made of rubber materials. The monometer 3 is a device that measures and indicates the pressure force that the user blows through the aperture tool. The manometer 3 comprises a pressure inlet 12. Preferably, the manometer 3 further comprises a case 11, which comprises a dial having graduations to indicate the pressure value during training in real-time. The first end opening 6 of the tube 2 is stretched and hermetically attached around the shank 5 of the aperture tool 1. Similarly, the second end opening 7 of the tube 2 is stretched and hermetically attached around the pressure inlet 12 of the manometer 3, such that the through aperture 8 is in fluid communication with the manometer 3.

In reference to FIGS. 2 and 3, the disc 4 provides a flat disc structure that comprises a top surface and a bottom surface with rounded edges 14. The through aperture 8 may go through the disc 4 and the shank 5. Preferably, the through aperture 8 is located on the center of the disc 4 and the shank 5. In a preferred embodiment, the shank 5 provides a cylindrical structure with a cone-shaped end 9. The cone-shaped end 9 comprises a rounded end edge 10. The disc 4 and the shank 5 are perpendicularly attached to each other in a concentrical position by a connection 13. The connection 13 is preferably rounded. The cone-shaped end 9 provides a tight seal when the tube 2 is covering the cone-shaped end 9 of the shank 5.

In reference to FIGS. 1, 2, 4, and 5, the tube 2 is preferably a flexible elongated tube, the tube 2 can be made of any suitable material, including but not limited to rubber. The tube 2 can be crimp down or expand.

Figure 5:
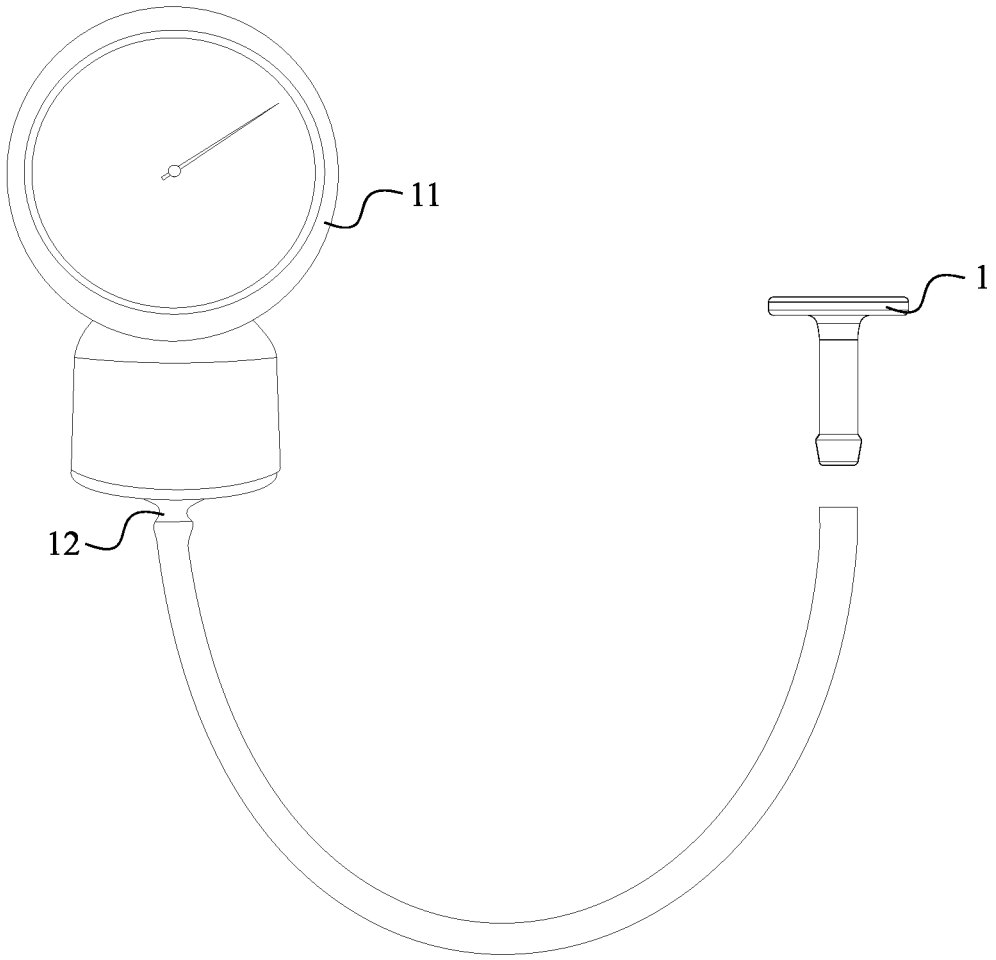
FIG. 5 is a front view of the compression training system of the present invention with the aperture tool detached.

In reference to FIGS. 1 and 5, the manometer 3 can be any air pressure measurement device that is available on the market. In one embodiment, the manometer 3 may be an electrical manometer or an analog manometer.

In reference to FIGS. 6 and 7, in a preferred embodiment, the pencil member 15 provides a cylindrical structure. The pencil member 15 can be placed between the user's teeth and enclosed by lips for compression training.

In reference to FIGS. 8, 9, and 10, in another preferred embodiment, the aperture tool can be a brass mouthpiece 16. The brass mouthpiece 16 comprises a rim 17, a cup 18, and a shank 19. The rim 17 is configured to rest against the user's lips. The cup 18 collects the sound made by the user's lips. The shank 19 allows a tight seal connection with the tube 2. The center of the rim 17 comprises a through aperture 20 that extends from the top surface to the bottom surface and through the cup 18 and the shank 19. The shank 20 provides a cylindrical structure. In this embodiment, the first end opening 6 of the tube 2 is inserted into the through aperture 20 from a bottom 21 of the shank 19 of the brass mouthpiece 16. It should be noted that the brass mouthpiece 16 can be any type of mouthpiece for brass instruments.

Although the invention has been explained in relation to its preferred embodiment, it is to be understood that many other possible modifications and variations can be made without departing from the spirit and scope of the invention as hereinafter claimed.

What is claimed is:

1. A compression training system, comprising: an aperture tool; a tube; a manometer; the tube comprising a first end opening and a second end opening; the aperture tool being releasably attached to the manometer via the tube; the aperture tool comprising a through aperture in communication with the first end opening of the tube; the aperture tool being shaped and sized to be placed between lips of a user; the manometer comprising a pressure inlet; and the second end opening of the tube being hermetically attached around the pressure inlet such that the through aperture is in fluid communication with the manometer:

the aperture tool comprising a disc and a shank;

the disc and the shank being perpendicularly connected by a connection;

the connection being disposed between the disc and the shank;

the connection being rounded;

the through aperture going through the disc and the shank.

2. The compression training system as claimed in claim 1, comprising:

the through aperture being located on the center of disc and the shank;

the disc comprising rounded edges;

the shank comprising a cone-shaped end;

the disc comprising a diameter;

the shank comprising a diameter;

the diameter of the disc is greater than the diameter of the shank;

the cone-shaped end comprising a rounded end edge; and the disc and the shank being positioned concentrically.

3. The compression training system as claimed in claim 2, wherein the first end opening of the tube being hermetically attached around the cone-shaped end.

4. The compression training system as claimed in claim 2 further comprising:

a pencil member; and the pencil member comprising a cylindrical structure.

5. The compression training system as claimed in claim 1, wherein the tube comprises a flexible elongated tube.

6. A compression training system, comprising: an aperture tool; a tube; a manometer; the tube comprising a first end opening and a second end opening; the aperture tool being releasably attached to the manometer via the tube; the aperture tool comprising a through aperture in communication with the first end opening of the tube; the aperture tool being shaped and sized to be placed between lips of a user; the manometer comprising a pressure inlet; and the second end opening of the tube being hermetically attached around the pressure inlet such that the through aperture is in fluid communication with the manometer:

the aperture tool being a brass mouthpiece;

the brass mouthpiece comprising a rim, a cup, and a shank; and the through aperture going through the rim, the cup, and the shank.

7. The compression training system as claimed in claim 6, wherein the first end opening of the tube is inserted into the through aperture from a bottom of the shank of the brass mouthpiece.

8. The compression training system as claimed in claim 7 further comprising:

a pencil member; and the pencil member comprising a cylindrical structure.

9. The compression training system as claimed in claim 6, wherein the tube comprises a flexible elongated tube.

* * * * *